United States Patent [19]

Poliak

[11] 4,402,565

[45] Sep. 6, 1983

[54] POSITIVE RETENTION ELECTRICAL CONNECTOR

[75] Inventor: John M. Poliak, East Meadow, N.Y.

[73] Assignee: Leviton Manufacturing Company, Inc., Little Neck, N.Y.

[21] Appl. No.: 207,486

[22] Filed: Nov. 17, 1980

[51] Int. Cl.[3] ..... H01R 13/58

[52] U.S. Cl. ..... 339/103 M

[58] Field of Search ..... 339/103 R, 103 M, 107

[56] References Cited

U.S. PATENT DOCUMENTS

| | | | |
|---|---|---|---|
| 2,920,304 | 1/1960 | Webster | 339/103 M |
| 3,437,980 | 4/1969 | Smith | 339/103 R |
| 3,500,286 | 3/1970 | Carlson et al. | 339/103 C X |

*Primary Examiner*—Eugene F. Desmond

*Attorney, Agent, or Firm*—Paul J. Sutton

[57] ABSTRACT

A positive retention connector has a hollow body for receiving a conductive wire and a housing insertable in the hollow body and adapted to support one or more terminal prongs connected to the wire and having means for positively engaging the periphery of the wire or its insulation for frictionally preventing relative movement between the wire and the connector. The retention means includes a plurality of prongs each having a friction surface adapted to engage the wire and a cam surface adapted to be engaged by the body as the housing is inserted therein for urging the friction surface of each prong against the wire. Means are also provided for securely attaching the terminal prongs, housing and body for retaining the wire with a minimal number of fasteners.

2 Claims, 10 Drawing Figures

POSITIVE RETENTION ELECTRICAL CONNECTOR

BACKGROUND OF THE INVENTION

This invention pertains to electrical connectors for electrically connecting a conductive wire to an electrical apparatus or source of electrical potential. More specifically, the invention relates to a connector on which there can be mounted terminals for connection to the respective conductors of a wire with the wire retained in the connector to prevent mechanical stress due to relative movement between the connector and wire on the connections between the conductors and terminals.

It is known in the art to provide mechanical stress relief between a wire and a connector to which the wire is attached by mechanically attaching the wire or its insulation to the connector body. In some wire and connector combinations of the prior art the exterior insulation on the wire and the body of the connector are fused together to mechanically join the wire and connector body and thereby provide stress and strain relief at the junction of the wire conductors with the connector terminals. Since this method of attachment is a permanent one, the connectors on such wires cannot be disconnected from the wire and reused. Electrical failure within such connectors must be corrected by replacement of the entire wire and connector assembly or substitution of a different type of connector. Connectors adapted for permanent attachment can also not be sold separately from the wires with which they are used for attachment by a user. Hence, from a commercial point of view they have limited market potential.

There is known in the art another type of connector which can be manually connected to and removed from a wire for reuse and which provides mechanical stress and strain relief between the conductors of the wire and the electrical terminals supported in the connector. Such connectors generally have a hollow cylindrical neck formed from a compressible material. The wire is received in the connector through a bore in the hollow neck and the neck is then compressed about the wire to form a frictional coupling between the wire and connector by means of a yoke which is circumscribingly mounted on the periphery of the neck of the connector and tightened to compress the neck against the wire to form the frictional coupling. To perform its intended function, the yoke used must be made of a hard rigid material which is usually a metal such as aluminum or steel. When the yoke is tightened it literally crushes the cylindrical neck on the connector and can damage it. Since the neck of the connector also serves as a means for grasping the connector, the yoke can interfere with the comfortable grasping of the connector. Moreover, since the yoke is often metallic and, therefore conductive, it presents a potential danger should the neck of the connector fracture and a live conductor in the wire come into contact with the yoke while it is being grasped by the user. The use of such yokes is also unsightly and presents a crude appearance in contrast to the neat finish of integrally molded connector and wire assemblies.

SUMMARY OF THE INVENTION

It is therefore an object of the instant invention to provide an electrical connector having means for mechanical coupling with a wire to be received in the connector for relieving stress and strain at the electrical connections between the terminals in the connector and the conductors of the wire.

Another object of the invention is to provide an electrical connector which can be manually connected and disconnected from a wire for use and reuse without need for special tools or skills.

Still another object of the invention is to provide an electrical connector suitable for frictionally retaining a wire without deforming the body of the connector.

A further object of the invention is to provide an electrical connector having a body which is suitable both for retaining a wire in the connector and supporting the terminals of the connector with a minimum number of fasteners.

Other and further objects of the invention will be apparent from the following drawings and description of a preferred embodiment of the invention in which like reference numerals are used to designate like parts in the various views.

DESCRIPTION OF THE PREFERRED EMBODIMENT

Figures 1, 2, 3:
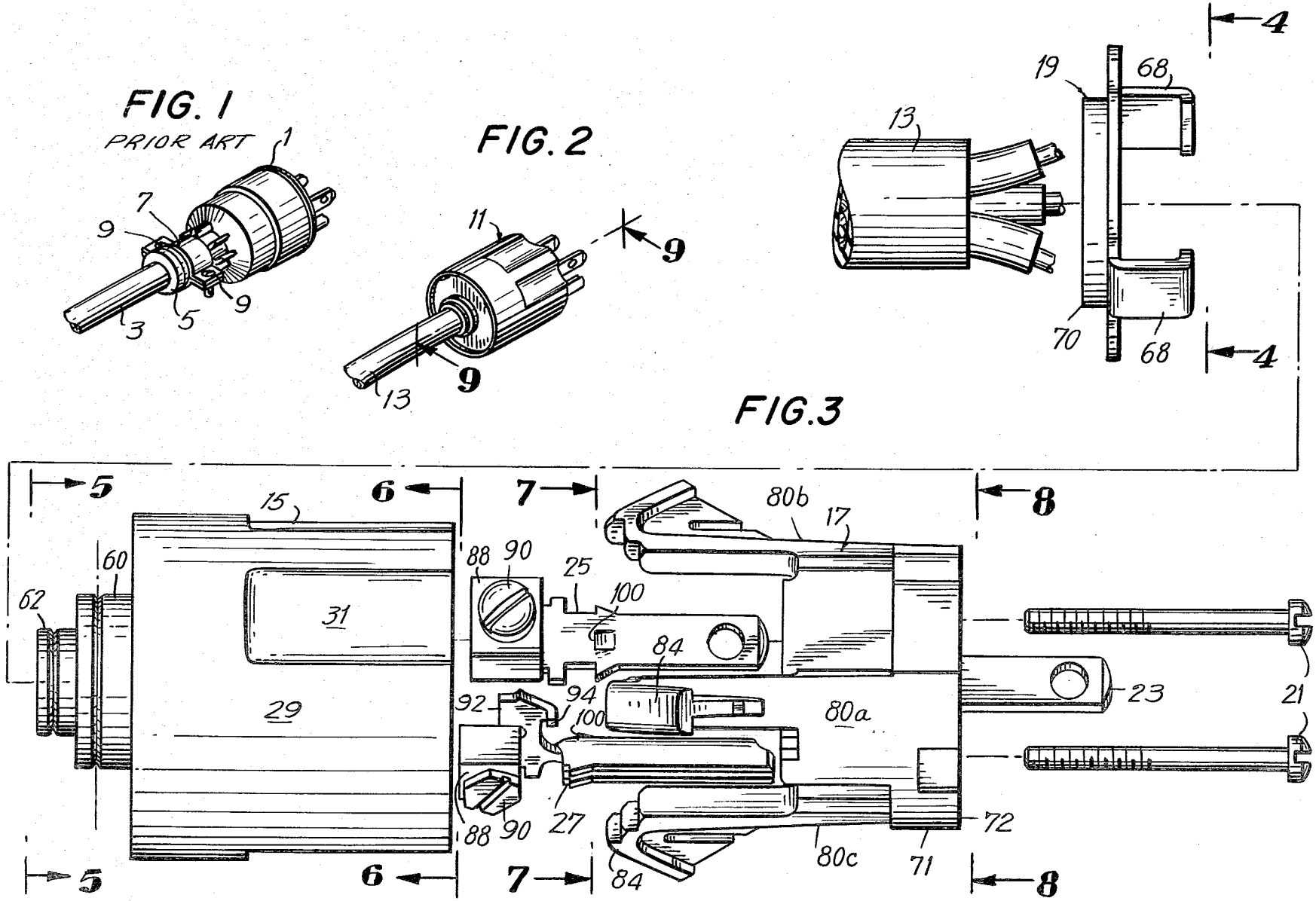
FIG. 1 PRIOR ART
FIG. 1 is a perspective view of an electrical connector known to the prior art and assembled with a wire for use in its intended environment.
FIG. 2 is a perspective view of a connector in accordance with the preferred embodiment of the invention assembled to a wire for use in its intended environment.
FIG. 3 is an exploded side elevation view of the connector of the preferred embodiment of the invention.

Referring now to FIG. 1 of the drawings, there is shown an electrical connector 1 in accordance with the prior art to which there is connected a wire 3. The body of the connector 1 has a neck 5 to which there is circumscribingly fastened a yoke 7. The yoke 7 includes two members held together by screws 9 which are tightened to compress the yoke 7 about the neck 5 thereby compressing the neck 5 against the exterior surface of the wire 3. As can be seen from FIG. 1, the yoke 7 is in a position where it is likely to be touched by the hand of a person connecting or disconnecting the connector 1 to or from an electrical outlet (not shown). Also because of the disposition of the screws 9, pressure is applied to the neck portion 5 of the connector 1 and to the wire 3 in the vertical direction as shown in FIG. 1 but not in the horizontal direction. This uneven pressure on the wire 3 results in a flattening of the wire and the neck portion 5 and can cause the neck portion 5 and/or wire 3 to fracture or wear more rapidly than would be the case in the absence of the yoke 7.

A connector 11 in accordance with the preferred embodiment of the invention is shown in FIG. 2 connected to a wire 13. As can be seen, the absence of the yoke 7 from the connector of the preferred embodiment of the invention shown in FIG. 2 makes for a neater appearance and allows the wire 13 to be free of potentially damaging forces along its length exterior to the connector 11.

Referring now to FIG. 3 of the drawings, the connector 11 includes a body 15 in the form of a hollow shell, a housing 17 adapted to be received within the hollow of the body 15, a retaining ring 19 adapted to be mounted on the posterior end of the body 15 and two screws 21 which serve to hold the retaining ring 19, body 15, and housing 17 together as will subsequently be shown.

The housing 17 is bored to support three electrical terminal prongs which permit the connector 11 to function as a standard grounding plug. The prongs which comprise the electrical terminals include a line prong 23, a neutral prong 25 and a grounding prong 27.

Figure 6:
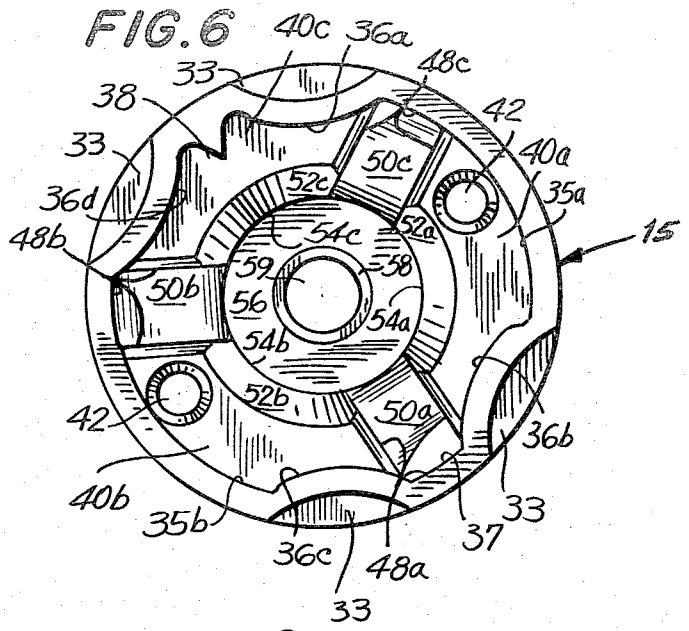
FIG. 6 is an end view of the component of the invention shown in FIG. 5 but taken facing the opposite end of the component.
Figure 5:
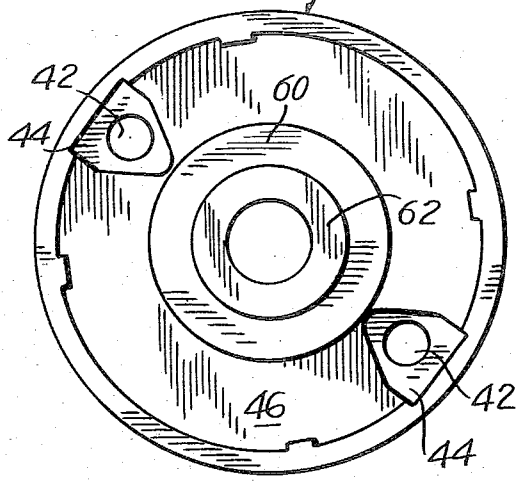
FIG. 5 is an end view of another component of the apparatus of the preferred embodiment of the invention taken through line 5—5 of FIG. 3.

The body 15 of the connector 11 will now be described with reference to FIGS. 3, 5 and 6. The body 15 is made of an insulating material which preferably has some resilience such as rubber. The body 15 has a substantially cylindrical outer wall 29 in which there are formed longitudinal indentations 31 which extend axially rearwardly from the anterior end of the body 15 approximately two-thirds the axial length of the body 15. The indentations 31 terminate at their posterior ends in shoulders 33 which cooperate with the indentations 31 to provide a grasping surface for holding the connector 11 as it is inserted or removed from a mating connector (not shown) such as a wall receptacle. As can be seen in FIG. 6 of the drawings, the body 15 has an enlarged bore at its interior end defined by concave walls 35*a* and 35*b*, convex walls 36*a*, 36*b*, 36*c* and 36*d*, a substantially planar wall 37 and a keying wall portion 38 having a substantially triangular cross-section. The convex walls 36*a–d* and portions of the concave walls 35*a*, 35*b* terminate posteriorly at spaced shoulders 40*a*, 40*b* and 40*c* which serve as seats for the housing 17. Through holes 42 are bored in the shoulders 40*a* and 40*b* and terminate within pentagonal recesses 44 (FIG. 5) in the posterior major surface 46 of the connector body 15. Between the shoulders 40*a*, 40*b* and 40*c* there are defined axial channels having adjacent wall portions 48*a* (coincident with planar wall 37), 48*b* and 48*c* which terminate posteriorly in shoulders 50*a*, 50*b* and 50*c* which are situated rearwardly of the shoulders 40*a*, 40*b* and 40*c*.

The shoulders 40*a*, *b* and *c* terminate at their radially inward extremities in posteriorly radially inward sloping engaging surfaces 52*a*, 52*b* and 52*c* respectively. The engaging surfaces 52*a*, 52*b* and 52*c* terminate posteriorly at axially posteriorly extending cylindrical wall portions 54*a*, 54*b* and 54*c* which run between the channels 48*a*, *b* and *c* and in turn terminate at a circular shoulder 56 through which there is an axial cylindrical bore extending rearwardly to a posterior circular shoulder 58. The shoulder 58 circumscribes a smaller diameter cylindrical bore 59 which extends to the posterior end of the connector body 15.

Figure 4:
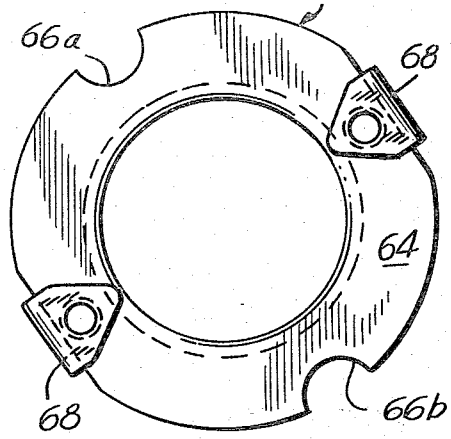
FIG. 4 is an end view showing a component of the apparatus of the preferred embodiment of the invention taken through line 4—4 of FIG. 3.

Extending from the posterior major surface 46 of the body 15 is an integral cylindrical boss 60 and extending posteriorly of the cylindrical boss 60 and coaxial with it is a smaller cylindrical boss 62 circumscribing the bore 59 which is adapted to receive the three conductor wire 13. The major surface 46 at the posterior end of the body 15 is slightly recessed within the surrounding posterior cylindrical wall to provide a seat for the retaining ring 19 which will now be described with reference to FIGS. 3 and 4.

The retaining ring 19 is preferably made of a rigid metal such as aluminum or steel although any other substantially rigid material will suffice. The ring 19 has an anterior planar surface 64 which is notched at 66*a* and 66*b* to accept a tool for separating the retaining ring 19 from the body 15. Extending anteriorly of the surface 64 at diametrically opposite edges of the retaining ring 19 are projections 68 each of which has a planar portion parallel to the axis of the ring 19 and a radially inwardly directed pentagonal portion of dimensions suitable for seating within the pentagonal recesses 44 in the connector body 15. The pentagonal portions of the projections 68 are apertured and threaded to receive the threaded portions of the screws 21. Surrounding the central aperture of the ring 19 is a cylindrical flange 70 which is of inner diameter substantially equal to the other diameter of the boss 60 extending from the posterior major surface 46 of the connector body 15 and which circumscribes the boss 60 when the ring 19 is seated on the posterior end of the connector body 15 with the projections 68 received in the recesses 44.

Figure 8:
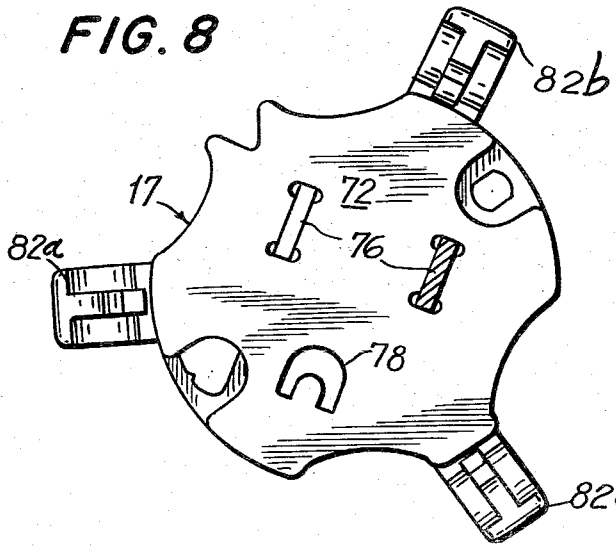
FIG. 8 is a sectional end view showing the components shown in FIG. 7 but taken along the line 8—8 of FIG. 3.
Figure 7:
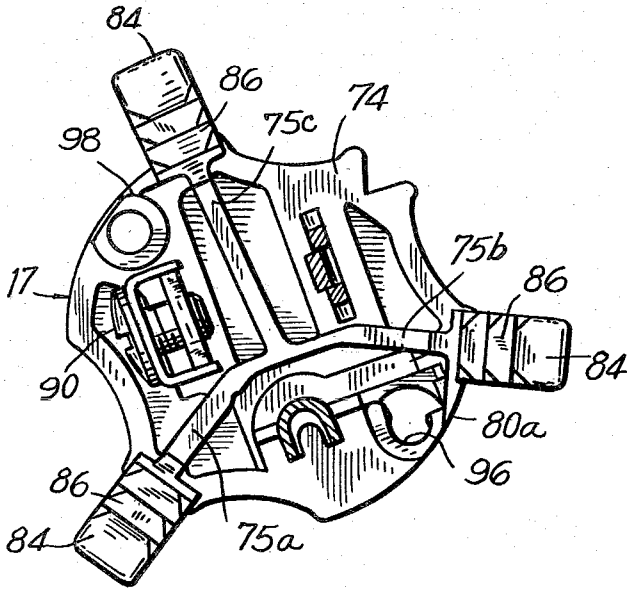
FIG. 7 is a sectional view showing other components of the apparatus of the preferred embodiment of the invention taken through line 7—7 of FIG. 3.

The housing 17 will now be described with reference to FIGS. 3, 7 and 8. The housing 17 includes a forward portion 71 having a substantially planar anterior surface 72 and an irregular posterior surface 74 from which there axially posteriorly extend three intersecting partitions 75*a*, 75*b* and 75*c*. The planar portion 71 of the housing 17 has two displaced axial bores 76 of I cross-section which are adapted to snuggly receive the terminal prongs 23 and 25 and a bore 78 of U cross-section which is adapted to snuggly receive the grounding terminal prong 27.

Extending axially posteriorly from the outer circumference of the forward portion 71 of the housing 17 are circumferential wall sections 80*a*, 80*b* and 80*c*. Extending axially posteriorly and radially inwardly from the posterior regions of the housing wall portions 80*a*, *b* and *c* are resilient prong members 82*a*, 82*b* and 82*c*. The prong members 82*a*, *b* and *c* each have an axially posteriorly radially outward facing cam surface 84 and an axially posteriorly and radially inwardly facing friction surface 86. The friction surfaces 86 have a serrated cross-section and are adapted to frictionally engage the outer insulation on the wire 13 when urged against the surface in a manner to be subsequently described.

The housing 17 is preferably made of a substantially rigid plastic although other insulating materials having similar rigidity characteristics can be used. The prong members 82*a*, *b* and *c* are integrally formed with the housing 17 and are thin walled at their juncture with the posterior ends of the housing portions 80*a*, *b* and *c* so that they can be bent inwardly when an axial force is applied to their respective cam surfaces 84. The prong members 82*a*, *b* and *c* are notched at their edges 99 opposite the friction surfaces 86 to allow flexing between the cam surfaces 84 and the portions of the prong members 82*a, b* and *c* adjacent the housing wall portions 80*a, b* and *c* to prevent fracture of the prong members 82*a, b* and *c* upon application of excessive force to the cam surfaces 84.

The terminal prongs 23, 25 and 27 have anterior ends adapted to extend from the anterior surface 72 of the housing 17 for insertion into aligning complementary receptacles (not shown) and posterior ends which are apertured and threaded and over which there are mounted U-shaped brackets 88 which are held in place by screws 90 which are threaded into the apertures at the posterior ends of the respective terminal prongs 23, 25 and 27.

The grounding terminal prong 27 has, at its posterior end, an integral extension 92 having a transverse flange 94 with a curved edge adapted to enclose a semicylindrical groove formed in the housing wall portion 80*a* at 96. A cylindrical sleeve 98 having an axis parallel to the axis of the connector 11 is integrally formed in the housing 17 diametrically opposite the groove 96.

To assemble the connector 11 with the wire 13, the prong terminals 23, 25 and 27 are inserted into their respective bores 76 and 78 in the housing 17 and the retaining ring 19 is placed over the bosses 62 and 60 of the body 15 with its projections 68 received in the recesses 44 of the body 15 and its cylindrical flange 70 circumscribing the boss 60. The wire 13, with part of its outer insulation stripped away to expose the three conductors of the wire is then inserted through the posterior end of the central axial bore in the connector body 15 and is extended from the anterior end of the body 15. The conductive core portions of the conductors in the wire 13 are then attached by means of the U brackets 88 and screws 90 to the respective terminal prongs 23, 25 and 27, that is, with the phase wire going to the prong 23, the neutral wire going to the prong 25 and the grounding wire going to the prong 27.

The housing 17 with the terminal prongs 23, 25 and 27 inserted in their respective bores is then inserted into the body 15 in the axial direction until the cam surfaces 84 of the prongs 82*a, b* and *c* engage the engaging surfaces 52*a, b* and *c* of the body 15. The housing 17 is then pushed farther into the body 15 thereby causing the prong members 82*a, b* and *c* to be forced radially inwardly toward the outer circumference of the wire 13 with the friction surfaces 86 being urged into the insulation on the wire 13 to frictionally prevent movement of the wire 13 relative to the housing 17. The housing 17 is pushed fully into the body 15 until the prong members 82*a, b* and *c* reach the ends of the channel 50*a*, 50*b* and 50*c* by which time the anterior surface 72 of the housing 17 is flush with the anterior end of the body 15.

The screws 21 are then inserted through apertures at the anterior end of the housing 17 which are in alignment respectively with the groove 96 and cylindrical sleeve 98 in the housing 17. The screws 21 pass through the apertures 42 in the body 15 and are then threaded into the threaded apertures in the projections 68 of the retaining ring 19 to complete the assembly of the connector 11.

Figure 10:
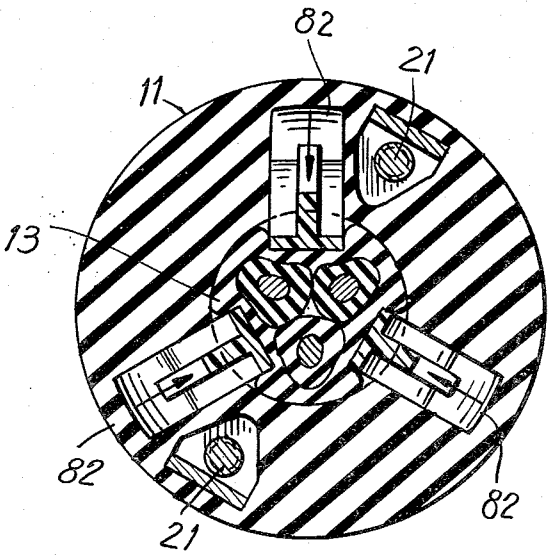
FIG. 10 is a cross-sectional view of the apparatus of the preferred embodiment of the invention taken along line 10—10 of FIG. 9.
Figure 9:
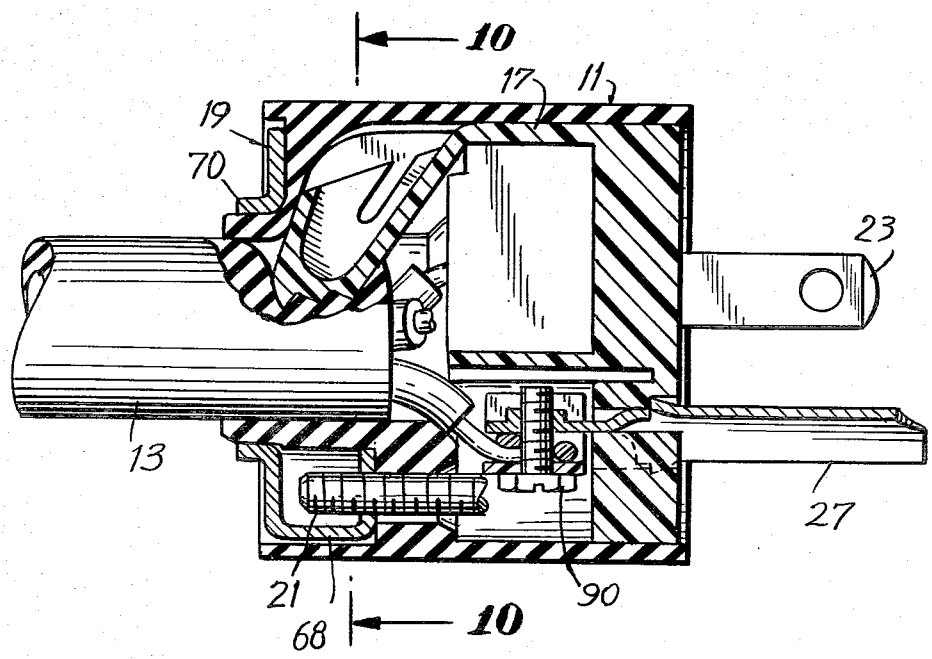
FIG. 9 is a side sectional elevation of the apparatus of the preferred embodiment of the invention taken along the line 9—9 of FIG. 2.

As can be seen in FIGS. 9 and 10, once assembly of the connector 11 has been completed in the above-described manner with the wire 13 inserted therein, the wire 13 is compressed by the prong members 82*a, b* and *c* thereby providing a positive retention of the wire 13 in the connector 11 without need for the use of clamps or braces to crush any portion of the body member 15 about the wire 13. In addition, the grounding terminal prong 27 is making contact with the head of the screws 21 as seen in FIG. 3 due to the interlocking relationship between the curved surface on the transverse flange 94 of the prong 27 and the threads on the engaged screw 90. Shoulders formed on the prongs 23, 25 and 27 limit their axial movement in an anterior direction and a small ramp defining a shoulder 100 on each of the terminal prongs prevents axial movement of the prongs in a posterior direction. The retaining ring 19 is grounded as a result of the high conductance path to the grounding prong 27 and its associated grounding wire provided by the screw 21 which is in contact with the terminal prong 27.

It is to be appreciated that modifications and variations may be made to the preferred embodiment of the invention described herein without departing from the spirit and scope of the invention which is defined in the following claims.

What is claimed is:

1. A connector apparatus for conductively securing a conductor to a receptacle comprising:

a hollow body having an axial bore for receiving said conductor in an axial position, a housing adapted to be received in said body, said housing having a plurality of friction surfaces, at least one movable prong including one of said plurality of friction surfaces, and a conductive terminal conductively coupled to said conductor, cooperative means on said body and said housing for urging said one prong against said conductor radially inward toward said axial position as said housing is inserted within said body, said body having an exterior end and an opposed interior end, said interior and being adapted to receive said housing, and a retainer ring having a ring axis coaxial with the axis of said axial bore and having an outer planar side and an opposed inner side, said retainer ring being adapted to be mounted on said exterior end of said body and being formed with openings for receiving fasteners which hold said housing to said body so as to form a unitary connector assembly, said exterior end of said body forming at least one pentagonal recess and said outer planar side of said retainer ring being parallel to said ring axis and having a radially inwardly directed pentagonal portion extending from said inner side adapted to be seated within said pentagonal recess, said retainer ring further having at least one notch at the circumference of said outer planar side.

2. Apparatus according to claim 1 comprising a plurality of prongs including said one movable prong, each prong of said plurality having one of said friction surfaces and a cam surface thereon, said cam surfaces being disposed for engagement by said body as said housing is mounted in said body, the friction surfaces of said prongs being urged upon said engagement toward a position at which said body is adapted to receive said conductor for securely grasping said conductor.

* * * * *